US007142169B1

(12) United States Patent
Lemke

(10) Patent No.: US 7,142,169 B1
(45) Date of Patent: Nov. 28, 2006

(54) APPARATUS AND METHOD FOR CONTROL OF A PRECISELY POSITIONABLE HIGH GAIN MICROWAVE ANTENNA

(76) Inventor: James U. Lemke, 7450 Olivetas Ave., D361, La Jolla, CA (US) 92037

( * ) Notice: Subject to any disclaimer, the term of this patent is extended or adjusted under 35 U.S.C. 154(b) by 59 days.

(21) Appl. No.: 11/263,146

(22) Filed: Oct. 31, 2005

(51) Int. Cl.
*H01Q 21/00* (2006.01)

(52) U.S. Cl. ..... 343/893; 343/853

(58) Field of Classification Search ..... 343/893, 343/853, 850, 757, 770, 810, 700 MS, 785
See application file for complete search history.

(56) References Cited

U.S. PATENT DOCUMENTS 6,906,679 B1 * 6/2005 Kneisel et al. ..... 343/816
6,987,491 B1 * 1/2006 Yukl ..... 343/853
6,987,493 B1 * 1/2006 Chen ..... 343/893

* cited by examiner

*Primary Examiner*—Hoanganh Le
(74) *Attorney, Agent, or Firm*—Daniel Robbins

(57) ABSTRACT

Two pairs of dielectric rod radiators are positioned on an antenna, with one pair in the azimuthal and the other in the elevational plane of the antenna radiation pattern. The axes of each pair are physically canted away from the direction of the main antenna beam. The radiation pattern of the dielectric rod elements is an electromagnetic "well" which is symmetrically located with respect to the axis of the main beam of the antenna with the antenna's beam centered in the "well". In aiming the antenna, for example, at a transmitting communication satellite, the amplitudes of signals received from the two dielectric rod azimuthal lobes are compared, and signals received from the two dielectric rod elevational lobes are similarly compared to provide servo error information for positioning the antenna beam. Signal processing may utilize a single multiplexed narrow band amplifier.

16 Claims, 10 Drawing Sheets

APPARATUS AND METHOD FOR CONTROL OF A PRECISELY POSITIONABLE HIGH GAIN MICROWAVE ANTENNA

BACKGROUND OF THE INVENTION

1. Field of the Invention

This invention relates to a positionable antenna, and in particular to a positionable narrow beam microwave antenna.

2. Description Relative to the Prior Art

The microwave antenna having a linear array of electromagnetic radiating slots is known in the art. The slots serve as dipoles, generally spaced at distances λ/2 apart, (λ=wavelength), and generate a highly directional single lobe radiation beam due to the mutual interference of the dipole outputs. Typically, slots arranged in a square array generate a beam that is narrow in both the azimuthal and elevational planes. An important feature of narrow beam antenna performance depends upon the accurate positioning of the beam in a selected direction to maximize signal transmission or reception. In the prior art, it is known that antenna servo control signals for antenna positioning in the azimuthal and in elevational directions may be derived by "dithering" the beam in the two orthogonal directions. "Dithering" consists in cyclically shifting the antenna's beam from its aimed position to alternately derive "left-right" and "up-down" received signal responses from the displaced beam whose amplitudes are compared and converted into servo control signals for positioning the antenna. Since it uses the r.f. information signal itself, this method generally reduces the signal-to-noise ratio of the antenna, as "dithering" requires the continuous sweeping of the antenna pattern through off axis directions.

It is also known in the art that an appropriately shaped dielectric rod antenna, which may be a ferrite, exhibits directional radiation characteristics when end-fed with microwave electromagnetic excitation. Dielectric rods are particularly effective when configured as elements of a microwave antenna array, and the use of dielectric rods as such directional antenna elements is described in detail in the article entitled "Ferrod Radiator System" by F. Reggia, E. G. Spencer, R. D. Hatcher, J. E. Tompkins, Proceedings of the IRE, 45 (1957) #3.

Seen in FIG. 1, a dielectric rod radiator, 10, has a dielectric shaft, 12, tapered to suppress side lobes, and to match its end impedance to a free space impedance of 377 ohms. This rod, fabricated from a dielectric material which may be a ferrite, has a permittivity of, e.g., 10, and a gain of 35 compared to a standard horn radiator. End fed with 1.5 cm electromagnetic energy, the directional radiation pattern, 14, of such a dielectric rod is shown in FIG. 2. The angle Θ is measured in the plane formed by the axis of the rod and a line perpendicular to the axis, the 0 of angle Θ being in the direction of the line perpendicular to the rod axis. The peak direction of the radiation pattern is along the rod axis, and hence occurs at $\Theta=\pi/2$. It will also be noted that due to reciprocity the pattern of an antenna is the same both for transmission and reception.

SUMMARY OF THE INVENTION

Rather than "dithering" the narrow beam of a microwave antenna to obtain antenna positioning servo control signals, the present invention teaches positioning two dielectric rod radiators in the azimuthal plane and two dielectric rod radiators in the elevational plane of the main antenna's beam radiation pattern. The two elements of each pair of dielectric rod elements are symmetrically positioned outboard with respect to the antenna's center of symmetry, and the axes of each pair are physically canted away from the direction of the main antenna beam. The composite radiation pattern of these canted dielectric rod elements is an electromagnetic "well" having identical lobes in both the azimuthal plane and in the elevational plane. The "well" is symmetrically located with respect to the axis of the narrow main beam of the antenna with the antenna's beam being centered in the "well". In aiming the antenna, for example, at a transmitting communication satellite, the amplitudes of signals received from the two dielectric rod azimuthal lobes are compared, and signals received from the two dielectric rod elevational lobes are similarly compared. The comparisons provide servo error information indicating the needed corrections in azimuth and elevation to position the antenna beam along the aimed direction. The signal connections of the pairs of dielectric rod elements are separate from the signal connections of the antenna itself, and the signal processing of the dielectric rod elements may be accomplished by means of a single multiplexed, low noise, narrow bandwidth amplifier. The bandwidth of the position correction system need only be on the order of several hertz for excellent antenna tracking with a resultant very high signal-to-noise ratio of the antenna positioning servo operation.

BRIEF DESCRIPTION OF THE DRAWINGS

The invention will be described with respect to the drawings of which.

DESCRIPTION OF THE PREFERRED EMBODIMENTS

EXAMPLE

An important application of current interest is communication over a microwave link between a moving vehicle and a satellite. Because of the mobility constraint, the vehicle's antenna radiating area is conventionally limited to dimensions of approximately 16"×16". The narrow main beam communication antenna used in combination with the present invention conforms to this geometry, and utilizes a square array of 13×13 dielectric rod radiating elements mounted on a face of a 16"×16" face of a microwave cavity. These elements are separated by a distance of 4λ/2 cm., i.e., 3 cm, corresponding to 20 Ghz. excitation, and according, only 13 radiators are needed to span the linear distance of 16".

Figure 1:
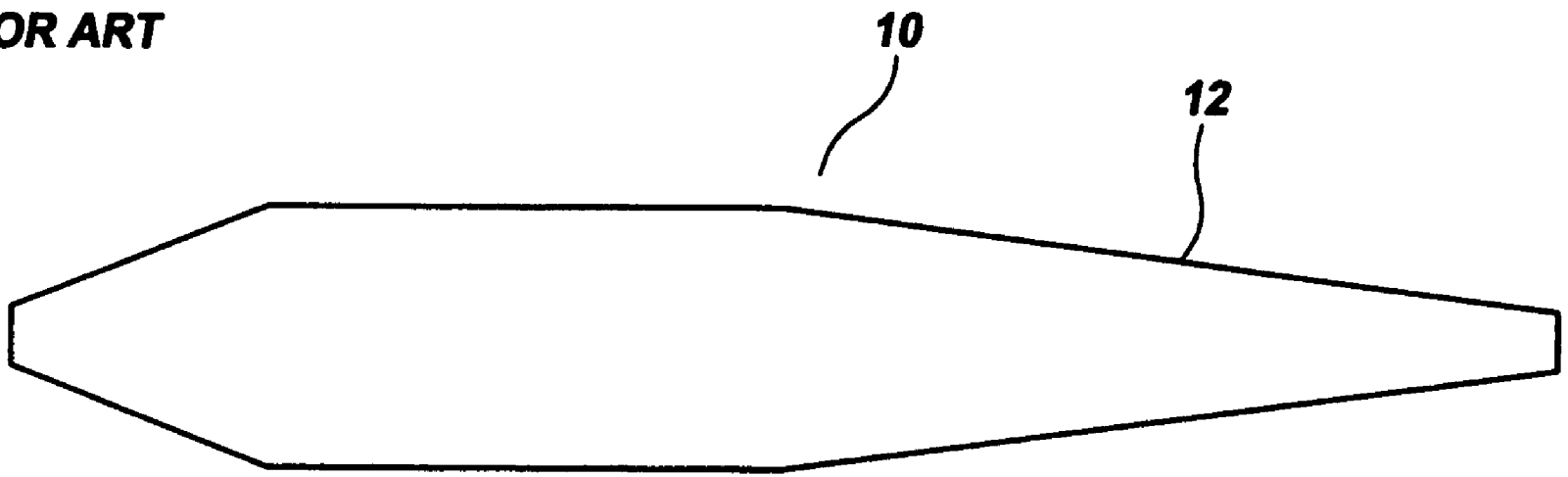
FIG.1 PRIOR ART
FIG. 1 is a drawing of a-dielectric rod radiator known in the art.
Figure 2:
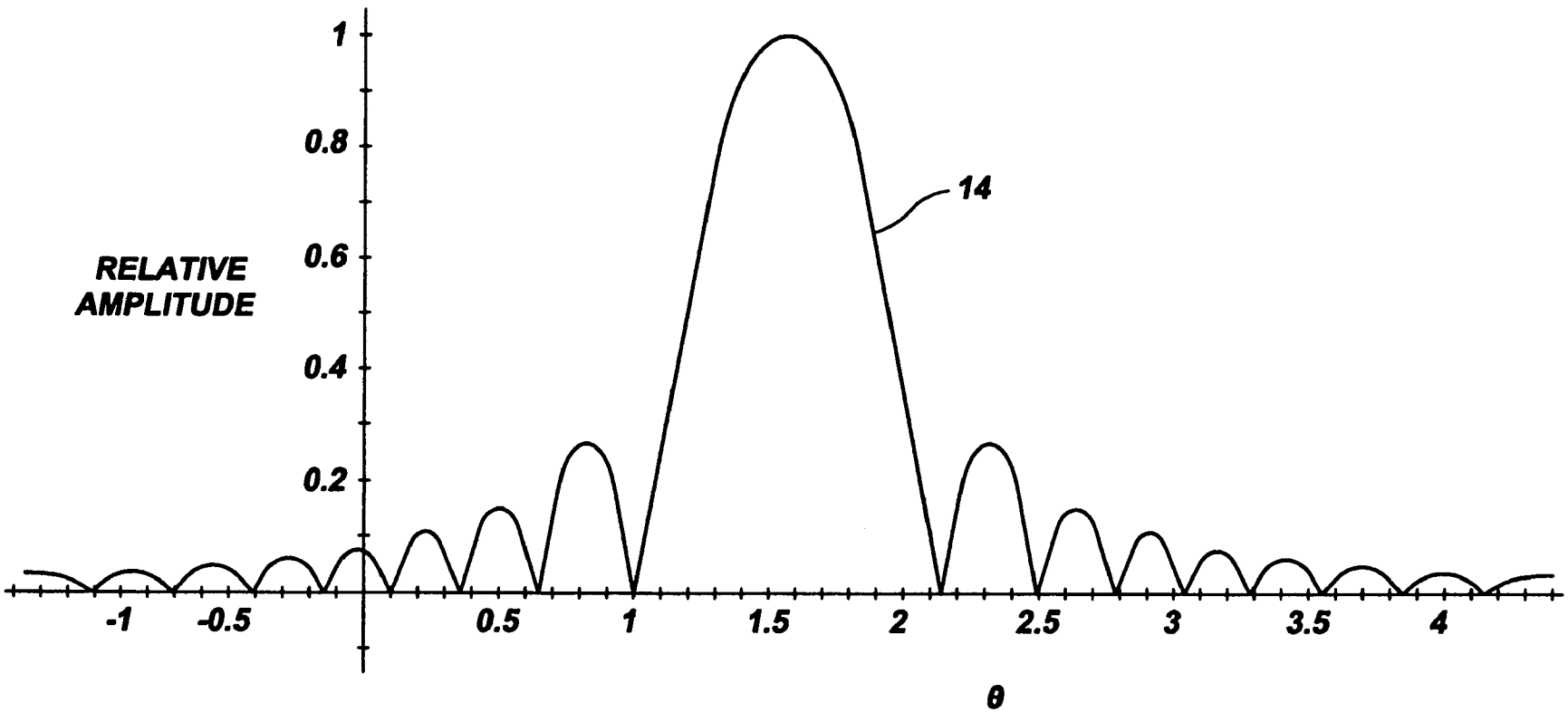
FIG.2 PRIOR ART
FIG. 2 is a plot of the radiation pattern of a dielecric rod known in the art.
Figure 3:
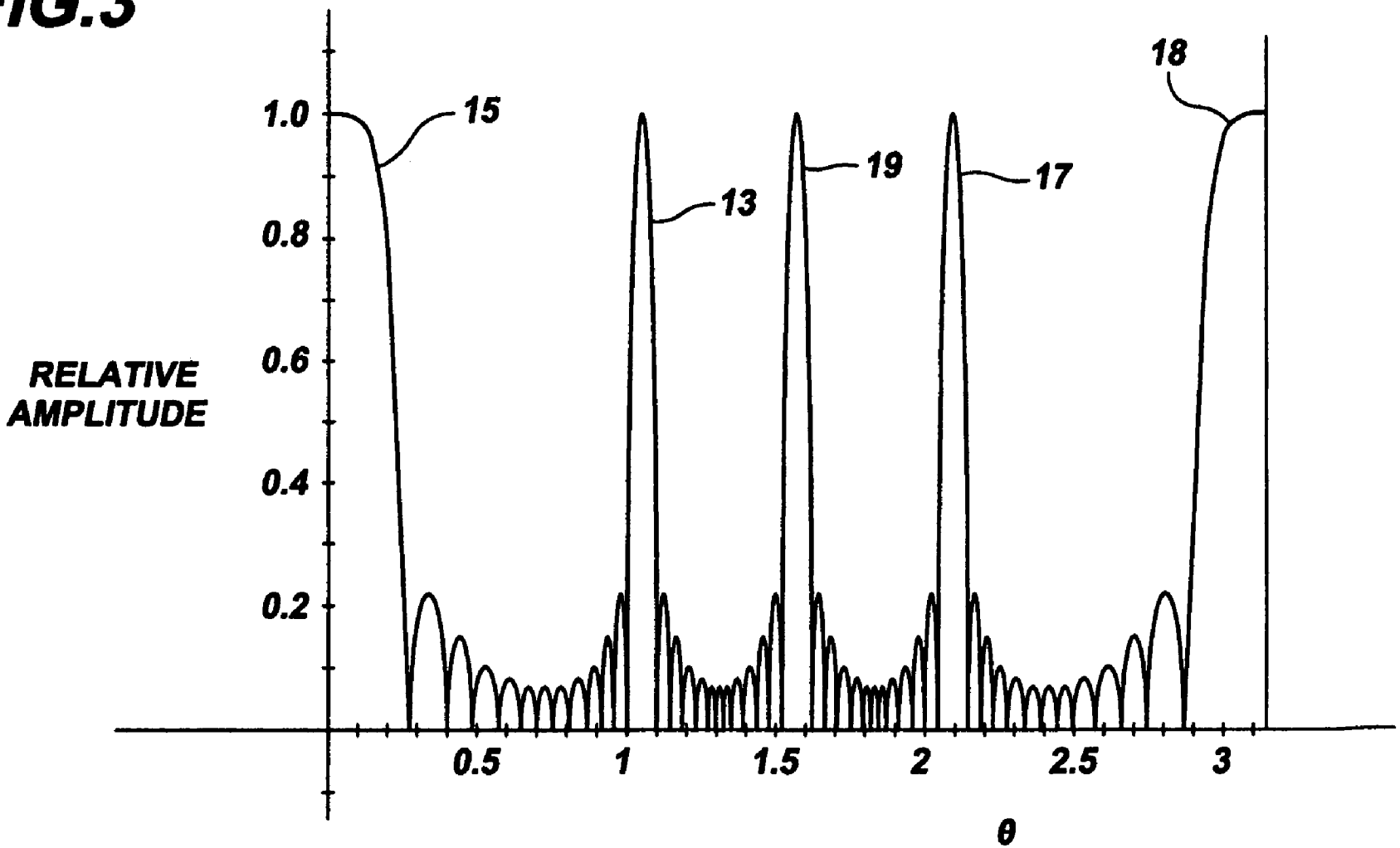
FIG. 3 is a plot of a multiple slot antenna radiation pattern, with slots placed greater than λ/2 apart.
Figure 4:
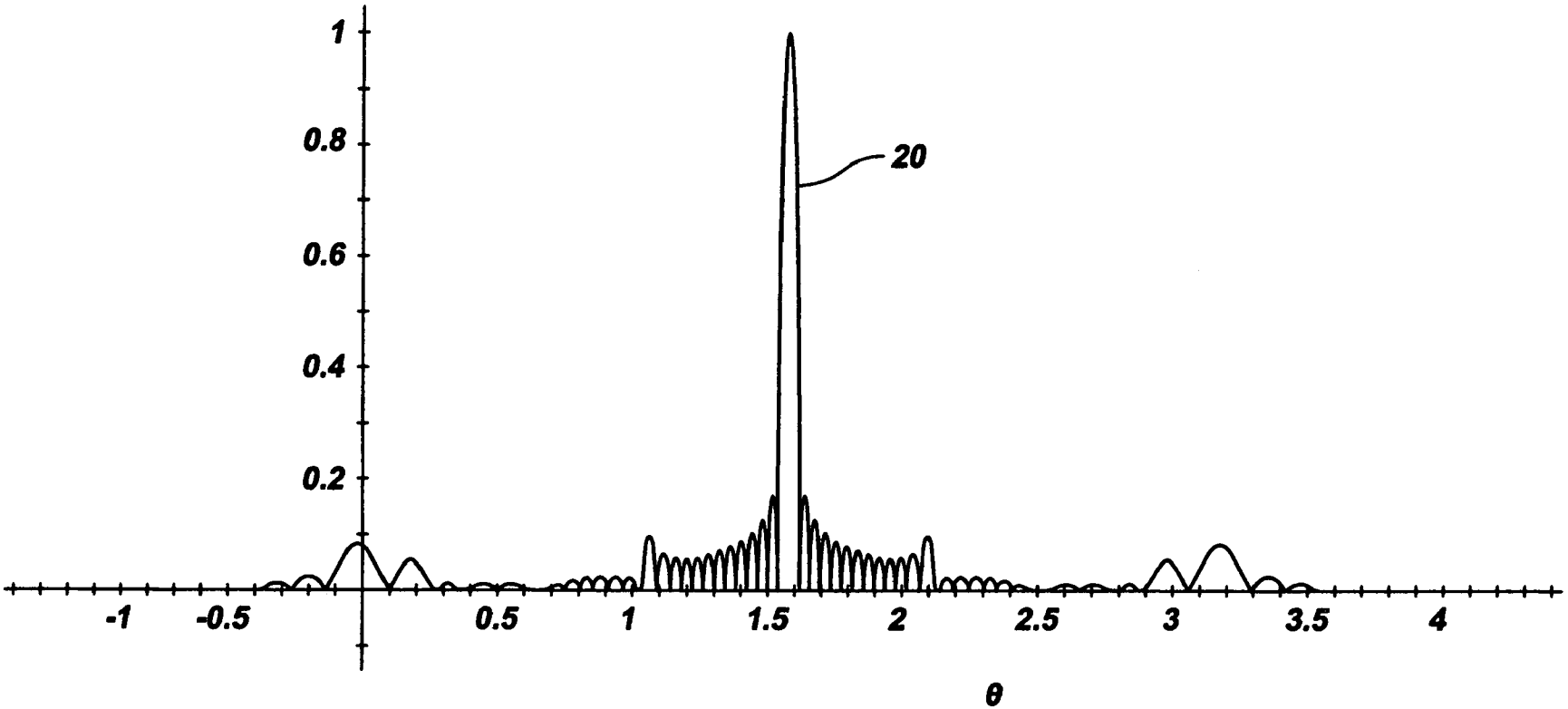
FIG. 4 is the plot of the radiation pattern of an antenna array used in combination with the present invention.

As is known in the art, radiator spacing greater than one half wavelength generate higher order lobe patterns having multiple grating maxima, and these multiple lobes would conventionally obviate the array's utility as a directional antenna. Referring to FIG. 3, the radiation pattern of a linear thirteen slot array having a spacing of 4λ/2 exhibits the higher order grating maxima, 13,15,17,18 in addition to the first order lobe 19, which would result in ambiguous directivity of a corresponding antenna array. However, unique directivity for such a slotted array is attained by replacing each isotropic slot radiator by an appropriately configured dielectric rod, 10, end fed by the array's electromagnetic excitation. The isotropic multiple slot radiation response illustrated in FIG. 3 is accordingly multiplied by the narrow beam directivity characteristic of the dielectric rod element plotted in FIG. 2, filtering out the grating lobes 13, 15, 17, 18, and retaining the single beam, 19. The resultant highly directional antenna radiation pattern, 20, is illustrated in FIG. 4.

Figure 5:
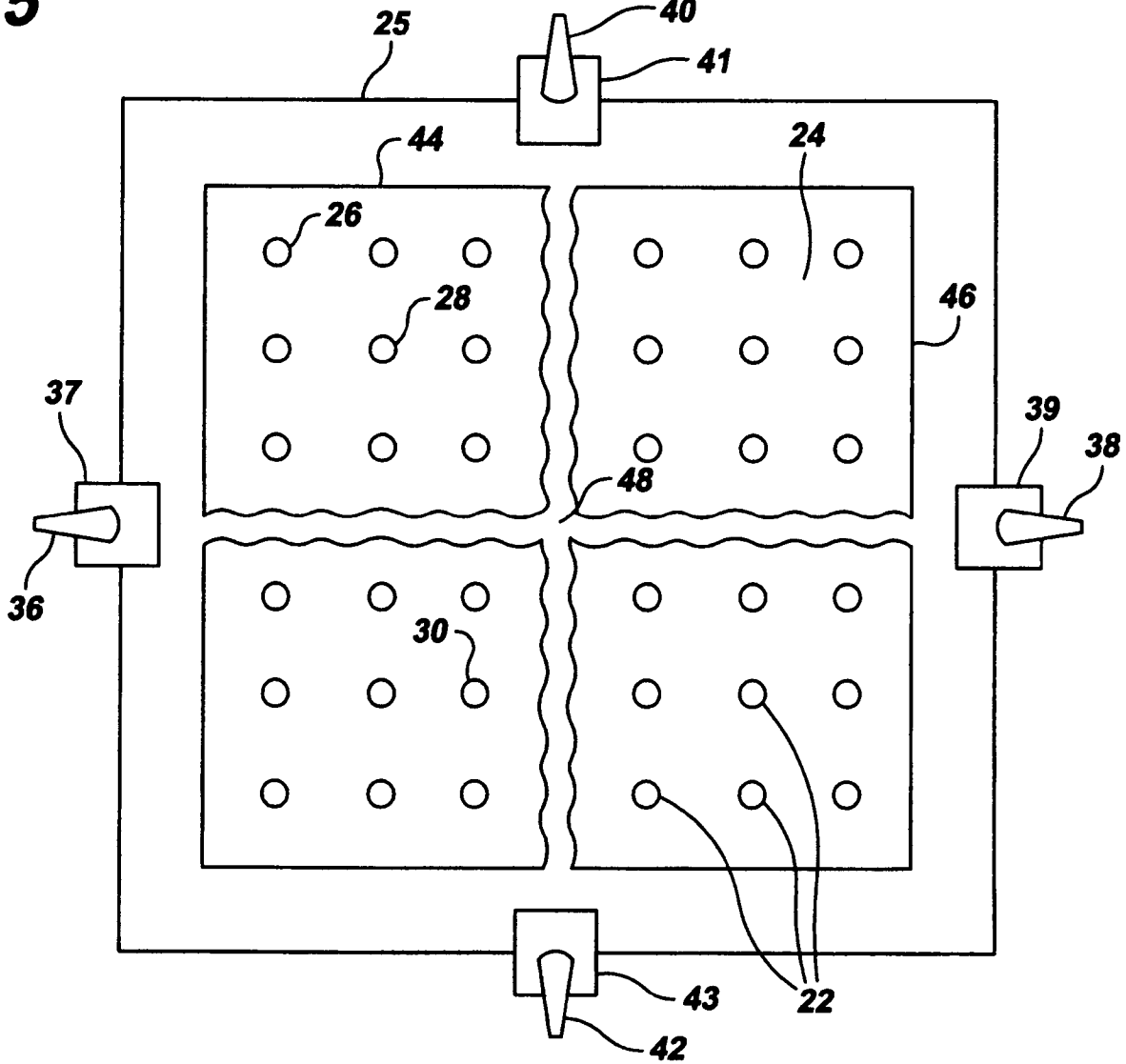
FIG. 5 is a plan drawing of an antenna utilizing dielectric rod radiators, further illustrating the dielectric rod elements used for antenna position determination, according to the present invention.

The efficacy of the dielectric rod radiator array may be appreciated in comparison to a slotted antenna of the same geometry filling the entire 16"×16" cavity face and requiring 54×54 slots, spaced λ/2 apart. By using dielectric rod radiators, the antenna of the present example only requires approximately $1/16^{th}$ as many radiators, i.e. 169 dielectric rod radiators vs 2916 slots. Since each dielectric radiator has approximately 35 times more gain than a corresponding isotropic slot, the gain of the dielectric rod antenna array of this example relative to that of the isotropic slot antenna is 10 log (35/16)=3.4 dB. Referring to FIG. 5, the array 22 has more than twice the gain of a corresponding isotropic slot antenna array. The dielectric rod element allows configuring a high gain antenna in a limited space, and its efficiency is correspondingly exploited in the antenna positioning apparatus of the present invention, disclosed below.

The antenna system of FIG. 5 comprises a microwave cavity, 24, configured for 1.5 cm electromagnetic radiation, feeding an array, 22, of 13×13 dielectric rods, e.g. 26,28,30, as described above. The microwave cavity, 24, is mounted in a structural framework, 25, which is mechanically controllable in elevation and in azimuth for antenna aiming. Additionally, in accordance with the teachings of the invention, an accurate antenna positioning capability for both azimuth and elevation is mounted on the structural framework, 25. Referring to FIG. 5, the antenna positioning capability comprises two additional pairs of dielectric rods, 36, 38 and 40, 42, which are mounted outboard on the structural framework, 25. The pair 36, 38 is located on a line parallel to a top edge 44 of microwave cavity 24, and the pair 40, 42 is located on a line parallel to a side edge 46 of microwave cavity 24. Each pair is symmetrically positioned with respect to the center of symmetry 48 of the array, 22.

Figure 6:
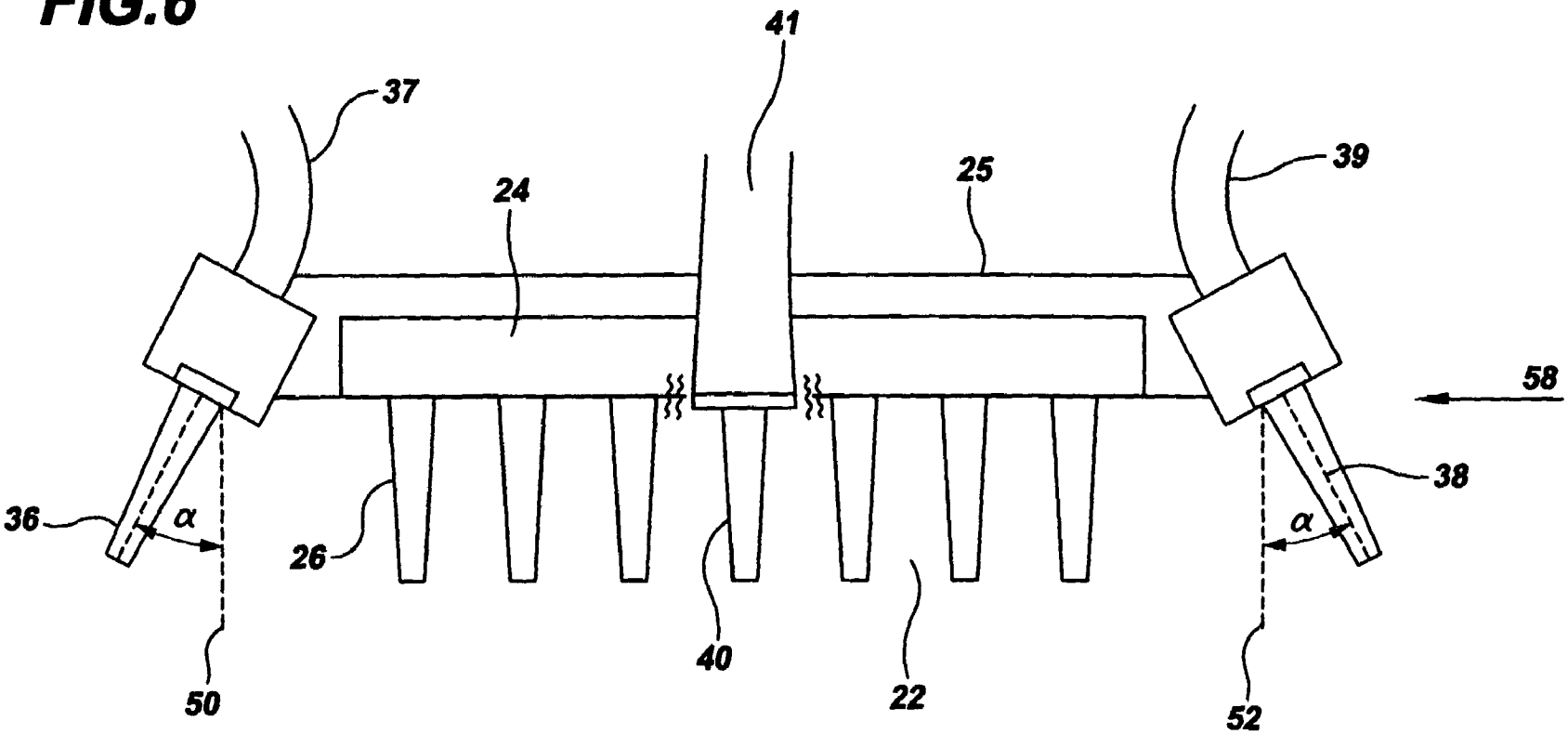
FIG. 6 is a drawing of the top view of FIG. 5.
Figure 7:
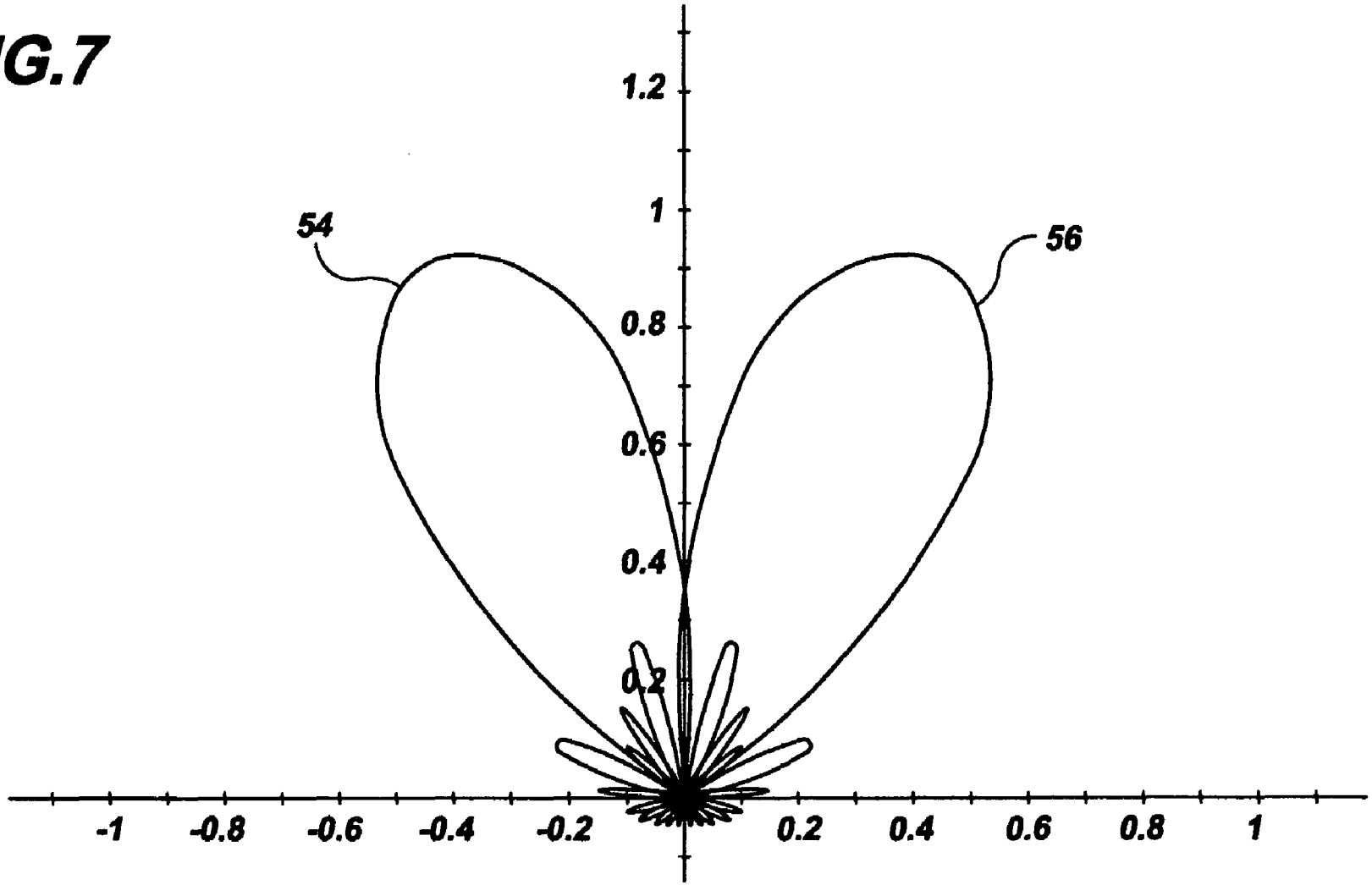
FIG. 7 is a plot of the azimuthal radiation pattern of a pair of canted rods in accordance with the present invention.

The pair 36, 38 lies in the azimuthal plane through the center of symmetry 48. Each dielectric rod 36, 38 is mounted on the structural framework, 25, and, referring to FIG. 6, the axes of dielectric rod 36,38 are each canted away from the center of symmetry 48 by an angle α relative to the lines, 50, 52 parallel to the axes of the antenna elements, e.g. 26, 28,30, which is also the direction of the beam of the antenna. The radiation pattern 54, 56 of the pair 36, 38, (FIG. 7), is generated in the azimuthal plane having as origin the center of symmetry 48, and the axis of the pattern is collinear with the axis of the antenna beam proper. The steepness of the azimuthal sides of the "well" is determined by the angle α, and a typical value for the angle is 25 degrees. The magnitude of the angle α, being a parameter of the antenna positioning servo, is ultimately determined by the overall dynamic and stability requirements of the positioning servo system.

Figure 8:
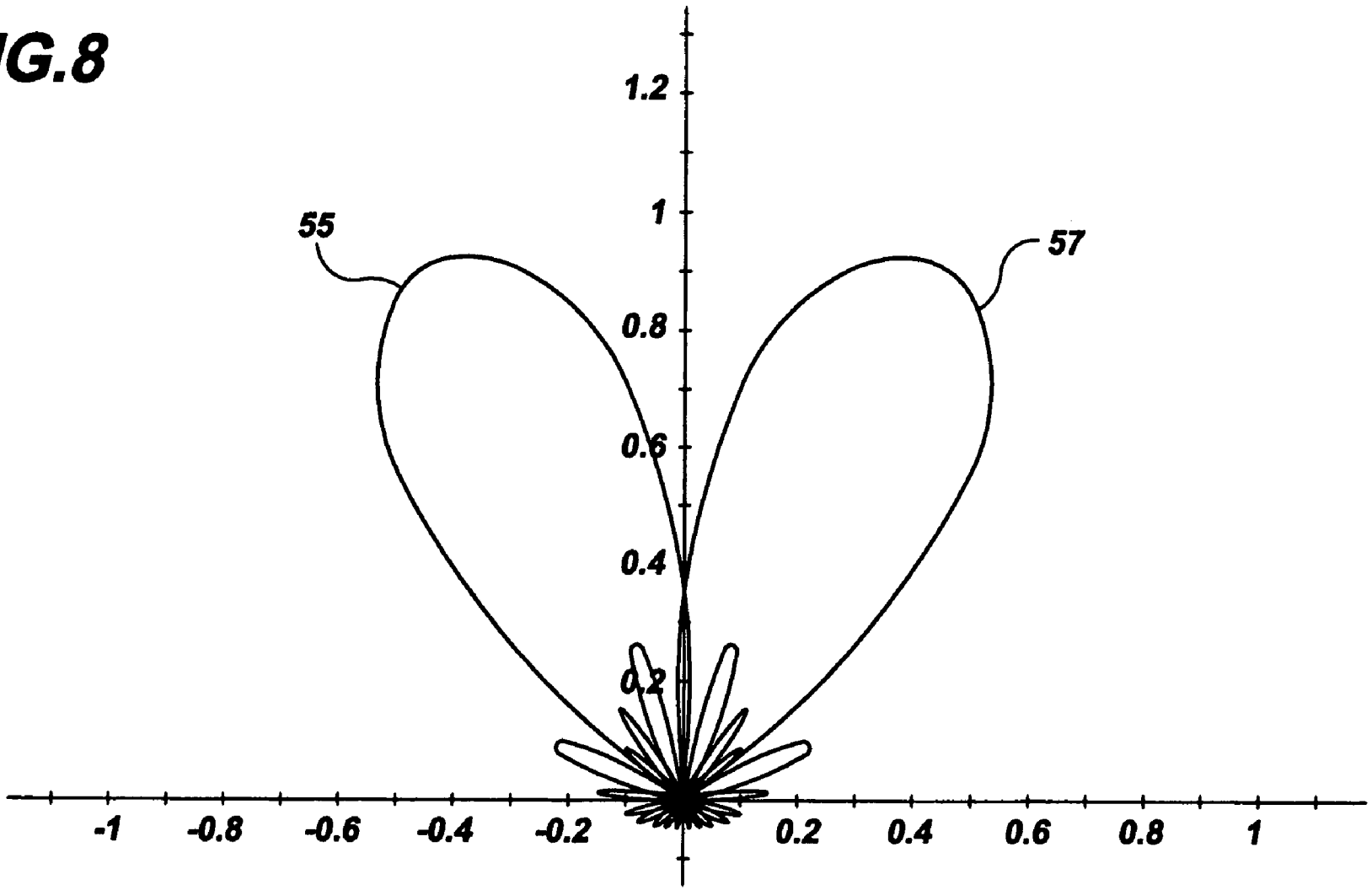
FIG. 8 is a plot of the elevational radiation pattern of a pair of canted rods in accordance with the present invention.

The radiation pattern 55, 57 shown in FIG. 8, is the corresponding radiation pattern in the elevational plane of the "well", and is determined by the dielectric rod pair 40, 42. The positioning of the dielectric rod pair 40, 42 in an elevational plane passing through the center of symmetry 48 exactly corresponds to that of the pair 36, 38. That is, looking at the antenna array 20 in the direction of the arrow 58 (FIG. 6), the dielectric rod rod pair 40,42 would be seen as mounted on the structural framework, 25, and each dielectric rod 40, 42 is canted away at the angle α, exactly corresponding to the geometry of the dielectric rod pair 36,38 of the azimuthal plane described above. Hence the radiation pattern 55, 57, (FIG. 8) of the dielectric rod pair 40, 42 in the elevational plane mirrors that of the of the pair 36, 38 in the azimuthal plane.

The dielectric rod pairs 36, 38 and 40, 42, while mounted on the structural framework 25 along with the microwave cavity, 24, are not electromagnetically coupled to the microwave cavity, 24, which has its own feed to a microwave receiver. They are coupled to independent waveguides 37, 39, 41, 43, respectively (or equivalently, to co-axial cable elements) which feed the outputs of dielectric rod pairs 36, 38 and 40, 42 to the antenna positioning processing equipment. The combined radiation patterns 54, 56 in the azimuthal plane and 55,57, in the elevational plane result in a deep well surrounding the point 48. As will be appreciated, since the radiation patterns from each of the dielectric rods, 40,42,36,38, extends in three dimensions about each dielectric rod's axis, the "well" is also three dimensional. It should also be remembered that the dielectric rods, 36, 38, 40, 42 are configured as passive receiving elements for determination of the precise direction of the transmitted beam from the associated satellite of the communication system. With the main lobe of the antenna of the example also centered in this well, the output signals received by the pair 36,38 and by the pair 40, 42, serve as inputs to the servo control for accurate pointing of the beam of the antenna array towards the associated transmitting satellite, or an associated transmitting terrestrial source.

Figure 9:
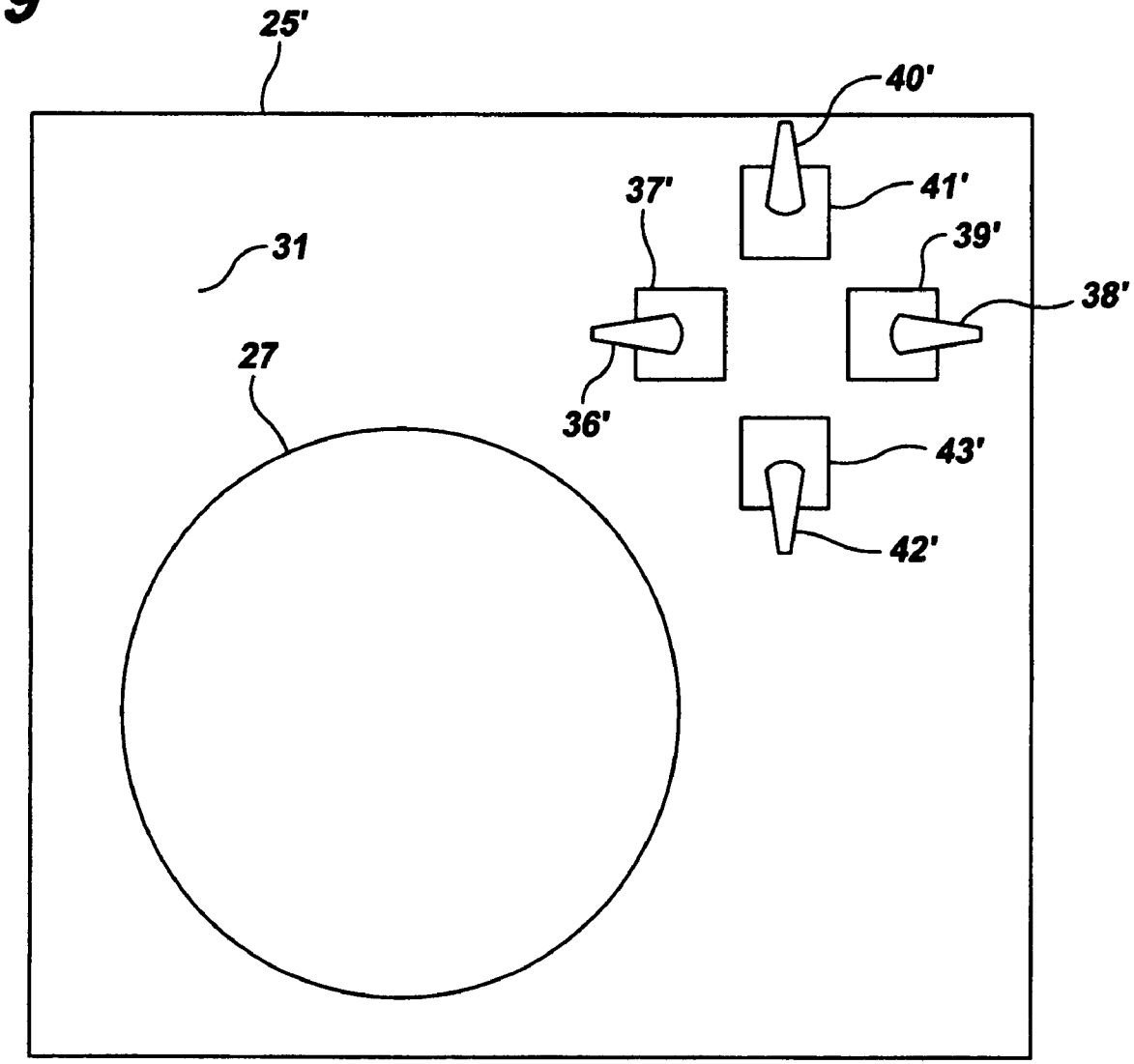
FIG. 9 is a drawing of a second embodiment of the invention.

In a second embodiment of the invention, the direction of the beam of an associated microwave antenna and the axis of symmetry of the "well" of the two pairs of rods of the invention are not required to be collinear as in the above embodiment, but are disclosed as parallel, although offset from each other. In this embodiment, the invention still provides excellent aiming of the antenna, since the far field radiation patterns of the antenna and of the pairs of rods of the invention, both in azimuth and elevation, overlap each other for offsets on the order of the widths of the patterns. Referring to FIG. 9, a microwave antenna, shown for example in the form of a spherically sectioned "dish", 27, known in the art, is mounted in a structural framework, 25'. (In the drawings, different but related elements are designated by the same reference character, albeit the different elements are distinguished by primes.) As is known in the art, such a "dish" has a radiation pattern in the form of a narrow beam aligned along its axis of symmetry. The "dish", 27, is fixed in the structural framework, 25', so that the antenna axis of symmetry and the antenna beam are normal to the plane surface, 31, of the structural framework, 25'.

This embodiment of the invention is implemented with the pair of rods 36', 38' for determination of azimuthal antenna positioning, and the pair of rods 40', 42' for determination of elevational antenna positioning. The rods 40', 42', 36' 38' are mounted on a convenient location on the plane surface 31, each rod being canted away from the normal to the plane 31, by angles α as previously described. Since the normal to the plane 31 is parallel to the direction of the beam 33, the axis of symmetry of the "well" formed by the radiation patterns of the rods 40',42',36,38', lies along the direction of the beam 33, as required for the practice of the invention.

Figure 10:
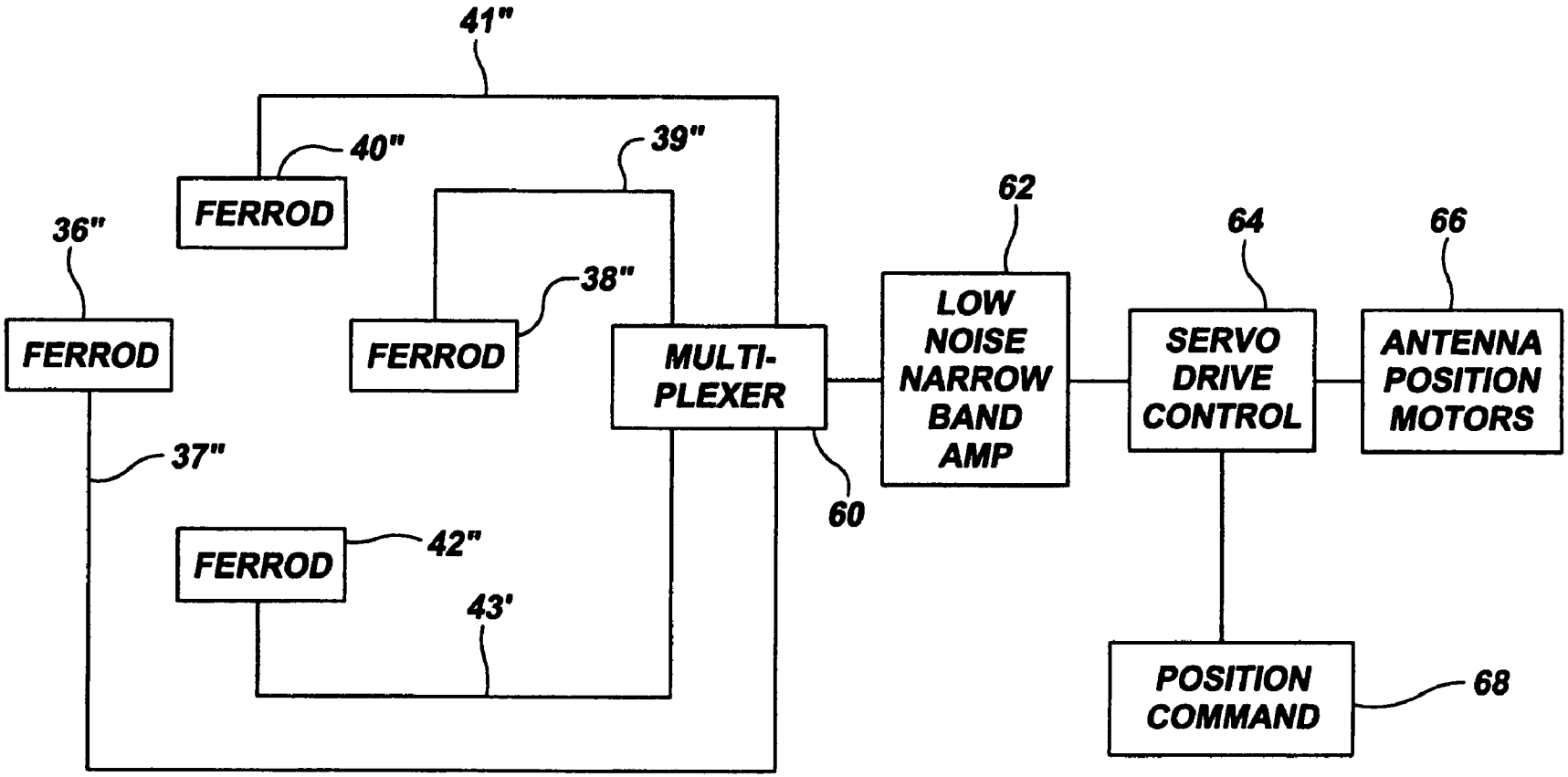
FIG. 10 is a block diagram of an antenna control servo system utilizing the positioning apparatus of the present invention.

Referring to FIG. 10, signals received by the dielectric rod pairs 36", 38", 40", 42" are sampled by a low level multiplexer, 60, that feeds a narrow band low noise amplifier, 62, to provide high signal to noise ratio data to the servo drive control unit, 64. The servo drive control unit, 64, compares the azimuthal signal from dielectric rod 36" and that of dielectric rod 38", to the position command, 68, generates an error signal which is used to drive the azimuth antenna positioning motor of unit 66, while the servo drive control unit 64 similarly compares the elevational signal from dielectric rods 40", 42" and the position command from signal, 68, to control the elevational antenna positioning motor of unit 66.

The invention has been described with reference to preferred embodiments thereof, but it will be understood that modifications and variations can be effected within the scope and spirit of the invention For example, rather than multiplexing the antenna position signals into a single amplifier, four independent amplifiers may be used to process the received signals from the individual dielectric rod radiator elements. Also, it will be appreciated than a symmetrical configuration of 3 canted rods will also generate a symmetrical "well" whose axis may be pointed in the direction of the associate array's beam to allow position discrimination of an incoming signal to provide antenna directional control.

It will be understood that the array can also be used for transmission to the source on which it is aligned after periodic reception alignment on signal from that source.

What is claimed is:

1. A microwave antenna position control apparatus cooperative with a microwave communication antenna positionable in azimuth and elevation, said microwave communication antenna comprising a first narrow electromagnetic beam emanating from an origin on said microwave communication antenna, said first electromagnetic beam having a fixed direction relative to said microwave communication antenna, said microwave antenna position control apparatus comprising:

a) a multiplicity of dielectric rod radiator elements proximate said microwave communication antenna, said multiplicity of dielectric rod radiator elements symmetrically positioned relative to said fixed direction, b) each of said dielectric rod radiator elements equidistant from said origin of said first electromagnetic beam, the axis of each of said dielectric rod radiator elements canted at an angle away from said fixed direction, c) means for electromagnetically coupling said multiplicity of dielectric rod radiator elements, whereby the resultant radiation pattern of said multiplicity of dielectric rod radiator elements is an electromagnetic radiation pattern in the form of an electromagnetic "well" having symmetry about said fixed direction, d) means for deriving elevation and azimuth control signals from said electromagnetic radiation pattern "well", whereby on reception of an incoming electromagnetic beam by said microwave antenna position control apparatus, said microwave communication antenna is positionable in elevation and azimuth so that said fixed direction is coincident with said incoming beam to facilitate communication with the source of said incoming beam.

2. The microwave antenna position control apparatus of claim 1 wherein said dielectric rod radiator elements are ferrite elements.

3. The microwave antenna position control apparatus of claim 1 wherein said dielectric rod radiator elements are mounted outboard of said microwave communication antenna.

4. The microwave antenna position control apparatus of claim 1 wherein said angle is an acute angle.

5. The microwave antenna position control apparatus of claim 1 wherein said means for electromagnetically coupling said multiplicity of radiator rod elements comprises a multiplicity of wave guides connected to cooperative signal processing apparatus.

6. The microwave antenna position control apparatus of claim 5 wherein first and second elevation related electromagnetic measurments of said electromagnetic radiation pattern provide elevational control signals for positioning said microwave communication antenna.

7. The microwave antenna position control apparatus of claim 5 wherein first and second azimuthal related electromagnetic measurements of said electromagnetic radiation pattern provide azimuthal control signals for positioning said microwave communication antenna.

8. A microwave antenna system of wavelength λ, said microwave antenna system positionable in azimuth and elevation by azimuthal tracking and elevational tracking of an incoming microwave signal of wavelength λ, said microwave antenna system comprising;

a) an antenna array having a multiplicity of dielectric rod radiator elements arranged in rows and columns, b) said dielectric rod radiator elements of each of said rows being mutually separated by a distance greater than λ/2, whereby said array provides a narrow beam radiation pattern, said narrow beam radiation pattern emanating from an origin on said array, said narrow beam radiation pattern extending in a fixed direction relative to said microwave antenna system, c) first and second antenna position determining dielectric rod radiator elements located on a line parallel to the elevation axis of said microwave antenna system, said first and said second antenna positioning dielectric rod radiator elements symmetrically positioned with respect to said origin, d) said first and said second antenna position determining dielectric rod radiator elements so constructed and arranged that the axis of each of said first and said second antenna position determining dielectric rod radiator elements is canted at an angle away from said fixed direction, e) third and fourth antenna position determining dielectric rod radiator elements located on a line parallel to the azimuth axis of said microwave antenna system, said third and said fourth antenna positioning dielectric rod radiator elements symmetrically positioned with respect to said origin, f) said third and said fourth dielectric rod radiator elements so constructed and arranged that the axis of each of said third and said fourth antenna position determining dielectric rod radiator elements is canted at an angle away from said fixed direction, and g) means for electromagnetically coupling said first, said second, said third and said fourth antenna positioning dielectric rod radiator elements with signal processing apparatus, whereby control signals for positioning said microwave antenna system in elevation and azimuth tracking are derived.

9. The microwave antenna system of claim 8 wherein said dielectric rod radiator elements are ferrite elements.

10. The microwave antenna system of claim 8 wherein said dielectric rod radiator elements are mounted outboard of said antenna array.

11. The microwave antenna system of claim 8 wherein said angle is an acute angle.

12. The microwave antenna system of claim 8 wherein said means for electomagnetically coupling said first, said second, said third and said fourth dielectric rod elements are first, second, third and fourth waveguide elements connecting to said signal processing apparatus.

13. The microwave antenna system of claim 12 wherein first and second elevational tracking signals derived from said first and said second dielectric rod radiator elements are fed through said first and said second waveguide elements for comparison in said signal processing apparatus, whereby elevational control signals for positioning said antenna system are derived.

14. The microwave antenna system of claim 12 wherein first and second azimuthal tracking signals received by said third and said fourth dielectric rod radiator elements are fed through said third and fourth waveguide elements for comparison in said signal processing apparatus, whereby azimuthal control signals for positioning said antenna system are derived.

15. A microwave antenna position control apparatus cooperative with a microwave communication antenna positionable in azimuth and elevation, said microwave communication antenna comprising a first narrow electromagnetic beam emanating from an origin on said microwave communication antenna, said first electromagnetic beam having a fixed direction relative to said microwave communication antenna, said microwave antenna position control apparatus comprising:

a) a multiplicity of dielectric rod radiators elements located proximate said microwave communication antenna, said multiplicity of dielectric rod radiator elements so constructed and arranged as to correspondingly move in azimuth and elevation with said microwave antenna, b) said multiplicity of dielectric rod radiator elements being canted away from said fixed direction and symmetrically organized to have a symmetrical radiation pattern "well", said "well" having an axis parallel to said fixed direction, whereby when a second beam is incident upon said microwave antenna control apparatus, and with adjustment of elevation and azimuth position of said microwave communication antenna said second beam is resultantly positioned along said "well axis", the far field resolution relative to said "well" axis and said first beam is such that said first beam points substantially in the direction of the source of said second beam.

16. A method of positioning a microwave antenna system having a narrow beam of fixed direction, said method including tracking an incoming microwave signal in azimuth and in elevation, said method comprising the steps of:

a) positioning first and second dielectric rod radiator elements on said antenna system on a line parallel to the elevational axis of said antenna system, b) canting the axes of said first and said second dielectric rod radiator elements at an angle with respect to said fixed direction, c) positioning third and fourth dielectric rod radiator elements on said antenna on a line parallel to the azimuthal axis of said antenna system, d) canting the axes of said third and said fourth dielectric rod radiator elements at an angle with respect to said fixed direction, e) comparing the level of said incoming microwave signal received by said first and said second dielectric rod radiator elements to generate an elevational error signal, f) driving said antenna system in elevation to reduce said elevational error signal, g) comparing the level of said incoming microwave signal received by said third and said fourth dielectric rod radiator elements to generate an azimuthal error signal, h) driving said antenna system in azimuth to reduce said azimuthal error signal.

* * * * *